US009754744B2

(12) United States Patent
Wan et al.

(10) Patent No.: US 9,754,744 B2
(45) Date of Patent: Sep. 5, 2017

(54) SELF-LEARNING RELAY TURN-OFF CONTROL SYSTEM AND METHOD

(71) Applicant: Emerson Electric Co., St. Louis, MO (US)

(72) Inventors: Lili Wan, Jiangsu (CN); Daxing Hu, Jiangsu (CN)

(73) Assignee: Emerson Electric Co., St. Louis, MO (US)

( * ) Notice: Subject to any disclaimer, the term of this patent is extended or adjusted under 35 U.S.C. 154(b) by 245 days.

(21) Appl. No.: 14/835,917

(22) Filed: Aug. 26, 2015

(65) Prior Publication Data

US 2017/0053760 A1 Feb. 23, 2017

(30) Foreign Application Priority Data

Aug. 19, 2015 (CN) ..... 2015 1 0512468

(51) Int. Cl.
*H01H 9/56* (2006.01)
*H01H 47/00* (2006.01)

(52) U.S. Cl.
CPC ..... *H01H 47/002* (2013.01); *H01H 9/56* (2013.01); *H01H 2009/566* (2013.01); *H01H 2047/009* (2013.01)

(58) Field of Classification Search
CPC ..... H01H 47/002; H01H 9/56
See application file for complete search history.

(56) References Cited

U.S. PATENT DOCUMENTS

| | | | | |
|---|---|---|---|---|
| 4,518,345 | A | 5/1985 | Mueller et al. | |
| 4,769,737 | A | 9/1988 | Ogita et al. | |
| 5,267,120 | A | 11/1993 | Graff et al. | |
| 5,329,417 | A | 7/1994 | Kniepkamp et al. | |
| 5,530,615 | A | 6/1996 | Miller et al. | |
| 5,640,113 | A | 6/1997 | Hu | |
| 5,804,991 | A | 9/1998 | Hu | |
| 6,137,193 | A | 10/2000 | Kikuoka et al. | |
| 6,233,132 | B1 | 5/2001 | Jenski | |
| 6,768,615 | B2 | 7/2004 | Liu | |
| 7,100,382 | B2 | 9/2006 | Butler et al. | |
| 7,298,148 | B2 | 11/2007 | Drake et al. | |
| 7,464,561 | B1 | 12/2008 | Butler et al. | |
| 7,522,400 | B2 | 4/2009 | Laurent et al. | |
| 8,817,431 | B2 | 8/2014 | Tomimbang et al. | |
| 2012/0112760 | A1 | 5/2012 | Yoscovich et al. | |
| 2015/0098164 | A1* | 4/2015 | Lenig | H01H 47/18 361/185 |
| 2016/0028564 | A1* | 1/2016 | Otani | H04L 25/069 398/25 |

* cited by examiner

*Primary Examiner* — Scott Bauer
(74) *Attorney, Agent, or Firm* — Harness, Dickey & Pierce, P.L.C.

(57) ABSTRACT

An exemplary embodiment is disclosed of a relay turn-off control system for use with an alternating-current (AC) signal input. The system may include a relay, a relay current load sensor connected to the relay, and a rectifier circuit connected to the relay current load sensor and having an output. A microprocessor may be connected to the rectifier circuit output. The microprocessor may be configured to set a relay turn-off signal output time based on an empirically determined duration time for the relay to turn-off and further based on determining a zero-cross period via use of a modulo operation.

11 Claims, 3 Drawing Sheets

SELF-LEARNING RELAY TURN-OFF CONTROL SYSTEM AND METHOD

CROSS-REFERENCE TO RELATED APPLICATION

This application claims the benefit and priority of Chinese Patent of Invention Application No. 201510512468.3 filed Aug. 19, 2015. The entire disclosure of the above application is incorporated herein by reference.

FIELD

The present disclosure relates to a self-learning relay turn-off control system and method.

BACKGROUND

This section provides background information related to the present disclosure which is not necessarily prior art.

In use switching relays may fail "open" when the mechanical switch arms fail to close and the relay cannot conduct a current. This failure may result from arcing between a contact and a mechanical switch arm as the relay turns-off during operation. This arcing damages the relay contact and switch arm and may cause a reduction of a useful life of the relay.

The amount of arcing and hence the destructive potential of the arcing is proportional to the current passing through the relay as the relay is attempting to turn-off. It is desirable to turn-off the relay during a zero-cross time of the AC current flowing through the relay.

The prior art has attempted to turn-off the relay during a zero-cross in several ways. For example, it is known to detect a delay time between a relay turn-off signal and the relay's load current cycle time. Based on the determined delay time, the turn-off signal timing is adjusted to open the relay near a zero-cross point. However, because of signal bounce conditions, a rather complicated algorithm is required to ensure that the relay's true turn-off time is detected.

Another solution, includes using an optical sensor to detect the arcing and adjusting the turn-off timing until little or no arcing is detected. The optical sensor is a custom solution for an application that results in increased costs.

Still another prior art solution, includes randomly varying the turn-off signal timing to reduce the likelihood of repeated high arcing turn-off times, thus protecting against relay failure. However, varying the turn-off signal times only reduces the chances of significant arcing and does not eliminate or minimize arcing.

Therefore, it is desirable to have a relay turn-off control system that self-learns a turn-off duration time of the relay during operation and quickly determines a turn-off signal time so the relay contacts open during or near a zero-cross point of the AC signal flowing through the relay.

SUMMARY

This section provides a general summary of the disclosure, and is not a comprehensive disclosure of its full scope or all of its features.

Examples are disclosed of a relay turn-off control system for use with an alternating-current (AC) signal input. The example relay turn-off control system may include a relay, a relay current load sensor connected to the relay, a rectifier circuit connected to the relay current load sensor and having an output, and a microprocessor connected to the rectifier circuit output. The example microprocessor may be configured to set a relay turn-off signal output time based on an empirically determined duration time for the relay to turn-off and further based on determining a zero-cross time via use of a modulo operation.

Example methods performed by a microprocessor of a relay turn-off control systems are also disclosed.

Further areas of applicability will become apparent from the description provided. The description and specific examples in this summary are intended for illustration only and are not intended to limit the present disclosure.

DRAWINGS

The drawings described are for illustrative purposes only of selected embodiments and not all possible implementations, and are not intended to limit the present disclosure.

Corresponding reference numerals indicate corresponding parts throughout the several views of the drawings.

DETAILED DESCRIPTION

Example embodiments will now be described more fully referring to the accompanying drawings.

The examples disclose relay turn-off control systems that apply to many applications and many relay types. In addition, the disclosed examples do not require a customized relay or expensive additional components, such as optical sensors, allowing the use of standard relays, leading to cost savings.

The present disclosure relates to a self-learning relay turn-off control system and method. In exemplary embodiments, the system includes a relay turn-off control measures a duration time for the system to turn-off the relay and utilize a modulo operation to open the relay during a zero-cross time of an AC signal input.

Figure 1:
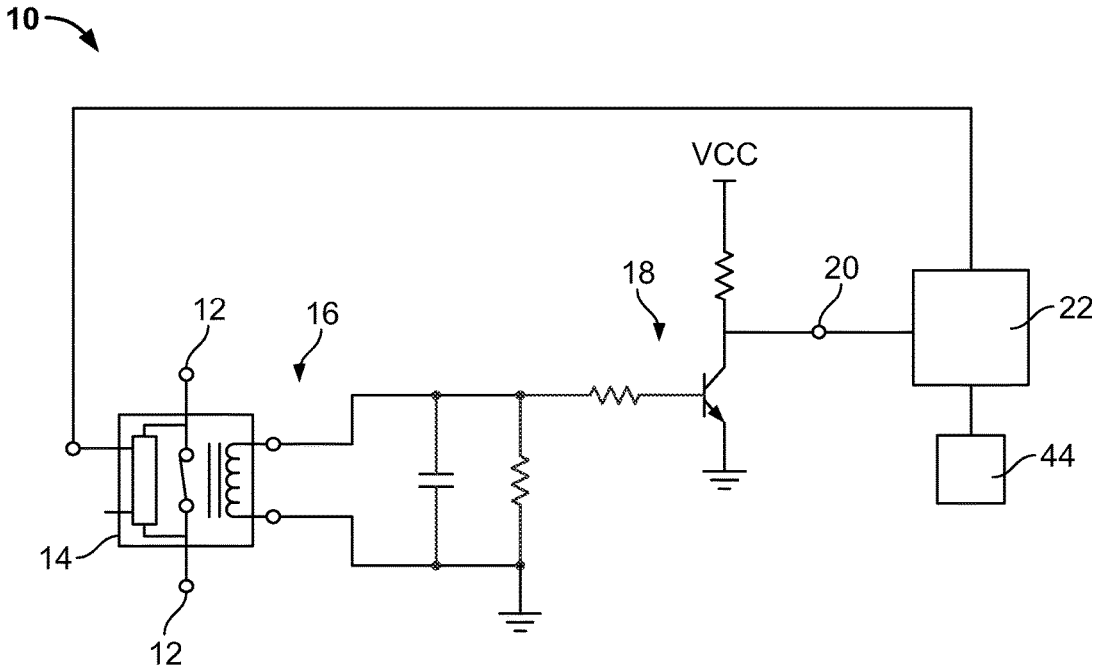
FIG. 1 is an example relay turn-off control system.

FIG. 1 illustrates a relay turn-off control system 10 for use with an alternating-current (AC) signal input 12. System 10 may include a relay 14, a relay current load sensor 16 connected to the relay 14, and a rectifier circuit 18 connected to the relay current load sensor 16 and having an output 20. A microprocessor 22 may be connected to the rectifier circuit output 20. The term microprocessor should be understood to include any appropriate computing or processing device such as general computer processors, programmable logic arrays, ASIC devices, a microcontroller, a central processing unit, equivalent analog circuits, or the like. The relay 14 may be any appropriate relay suitable for a particular application and may include relays such as Tyco® T9A, American Zettler® AZ2500P2, Panasonic® JQ1PF, OMRON® G5Q, and others as appropriate.

Figure 2:
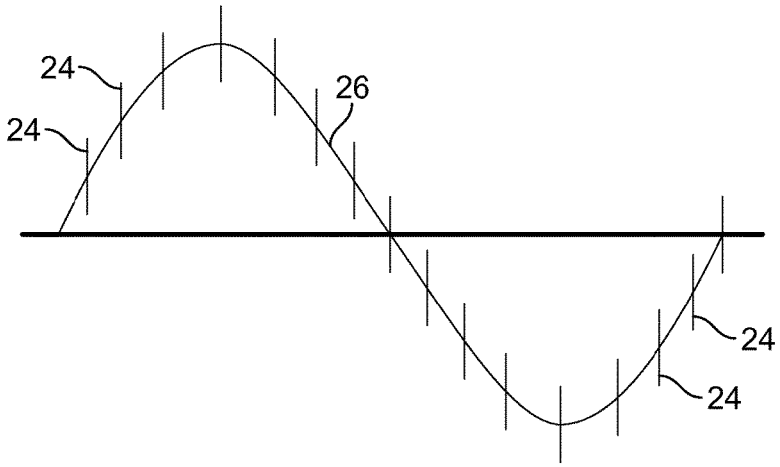
FIG. 2 is an example AC signal input divided into a plurality of successive time increments.
Figure 3:
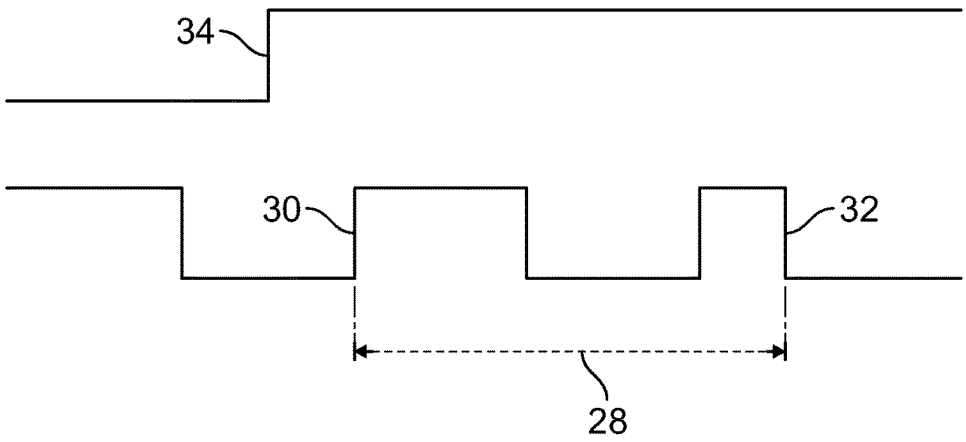
FIG. 3 is an example timing diagram illustrating an example duration time.
Figure 4:
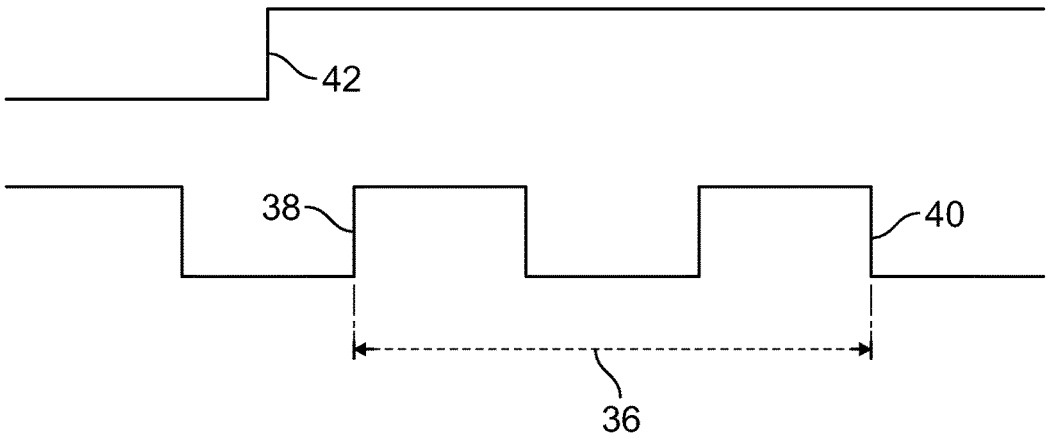
FIG. 4 is another example timing diagram illustrating another example duration time.

The microprocessor 22 may be configured to:

a) define a plurality of successive time increments where each of the plurality of successive time increments combined are equal to a cycle time of the AC signal input. An example plurality of successive time increments 24 is shown in FIG. 2. The example of FIG. 2 shows 16 time increments 24 applied to a cycle time of AC signal input 26. The cycle time may be divided into more or fewer equal time increments depending on the design requirements; for example the number of successive time increments may be 16, 32, 64, or another number.

b) output a first relay turn-off signal to the relay 14 at a first of the plurality of successive time increments.

c) measure a duration time, after step b or f, for the rectifier circuit 18 at output 20 to indicate that the relay 14 has turned off (also referred to as opened). The duration time may be measured from a time the microprocessor 22 outputs a turn-off signal until the output 20 goes low for a time greater than half a cycle time. Said another way the time duration may be measured, beginning after the microprocessor 22 outputs a turn-off signal, from a first rising edge to a last falling edge of the rectified square wave signal generated at rectifier circuit output 20. The rectified square wave may be synchronous with the AC signal input 12. The duration time is shown in the example timing diagrams of FIGS. 3 and 4. The duration time of FIG. 3 is shown at reference 28 and may be measured from a first rising edge 30 to a last falling edge 32, after the microprocessor outputs a turn-off signal at 34. Similarly, the FIG. 4 example shows the duration at reference 36 and may be measured from rising edge 38 to falling edge 40, after the microprocessor outputs a turn-off signal at 42.

d) perform a modulo operation of (duration time) mod (cycle time/2), wherein a remainder of the modulo operation is one of a non-zero value and a zero value. The remainder of the FIG. 3 example is a non-zero value and indicates that the relay turned off during a positive portion of the AC cycle. The remainder of the FIG. 4 example is a zero value and indicates that the relay turned off during a negative portion of the AC cycle.

e) store the remainder and an associated time increment in a memory 44 coupled with the microprocessor 22. The memory 44 may be any appropriate data storage device, such as RAM, DRAM, SRAM, volatile or non-volatile memory, flash, ROM, PROM, EPROM, EEPROM, tapes, magnetic discs, optical discs, or the like.

f) output a next relay turn-off signal to the relay at a next of the plurality of successive time increments. In the disclosed examples, FIG. 3 may be the first relay turn-off signal output of step b and FIG. 4 may be the next relay turn-off signal output of step f. At step f, the microprocessor increases the turn-off signal output time by one time increment. If the AC signal is 60 Hz, the AC cycle time is approximately 16.7 milliseconds (ms) and each time increment 24 represents about 1 ms, then the next successive time increment is 2 ms. To perform the modulo operation, in an example where the duration time in 15.2 ms and the half-cycle time is approximately 8.35 ms, each value may be multiplied by 100 to result in integer values for the modulo operation. Thus in this example, the modulo dividend value is 1520 and the divisor is 835. In other examples, the duration time and half-cycle time may each be multiplied by 10, 1000, or other appropriate values to create dividend and divisor integer values for the modulo operation.

g) repeat steps c-f until the stored remainders of successive modulo operations transition from the non-zero value to the zero value or from the zero value to the non-zero value. In this example, the self-learning may be complete after two turn-off signals are output or after, at the most, 16 turn-off signals are output before the successive remainder transitions are detected no earlier than 1 ms. If another number of time increments is set, the maximum number of possible turn-off signal outputs will change accordingly. In this way, the disclosed example relay turn-off control system quickly self-learns the time adjustment needed to turn-off relay 14 during a zero-cross period of the AC signal 12.

h) set a relay turn-off signal output time at the associated time increment where the remainder of successive modulo operations transitioned from the non-zero value to the zero value or from the zero value to the non-zero value. For the example where each time increment represents 1 ms and the remainder transition is detected between 3 ms and 4 ms, the zero-cross period is assumed to have occurred, and the microprocessor stores and sets the third associated time increment (3 ms, in this example) as the relay turn-off signal output time.

Another way of describing the configuration of microprocessor 22 may be that the microprocessor 22 is configured to set a relay turn-off signal output time based on an empirically determined duration time for the relay to turn-off and further based on determining a zero-cross period via use of a modulo operation. The empirically determined duration time may include measuring, after the microprocessor outputs a relay turn-off signal to the relay, a time for the rectifier circuit output to indicate that the relay has turned off.

In other examples, the rectifier circuit 18 may be replaced with an analog-to-digital (A-D) converter and still detect the positive and negative portions of the AC signal input and determine the zero-cross period, similarly to the example disclosed above.

If the duration time is only determined once then the microprocessor 22 configuration steps to determine the zero-cross period may:

a) define a plurality of successive time increments where each of the plurality of successive time increments combined are equal to a cycle time of the AC signal input;

b) perform a modulo operation of (duration time) mod (cycle time/2), wherein a remainder of the modulo operation is one of a non-zero value and a zero value;

c) store the remainder and an associated time increment in a memory coupled with the microprocessor;

d) output a next relay turn-off signal to the relay at a next of the plurality of successive time increments;

e) repeat steps b-d until the stored remainders of successive modulo operations transition from the non-zero value to the zero value or from the zero value to the non-zero value; and f) set a relay turn-off signal output time at the associated time increment where the remainder of successive modulo operations transitioned from the non-zero value to the zero value or from the zero value to the non-zero value.

Figure 5:
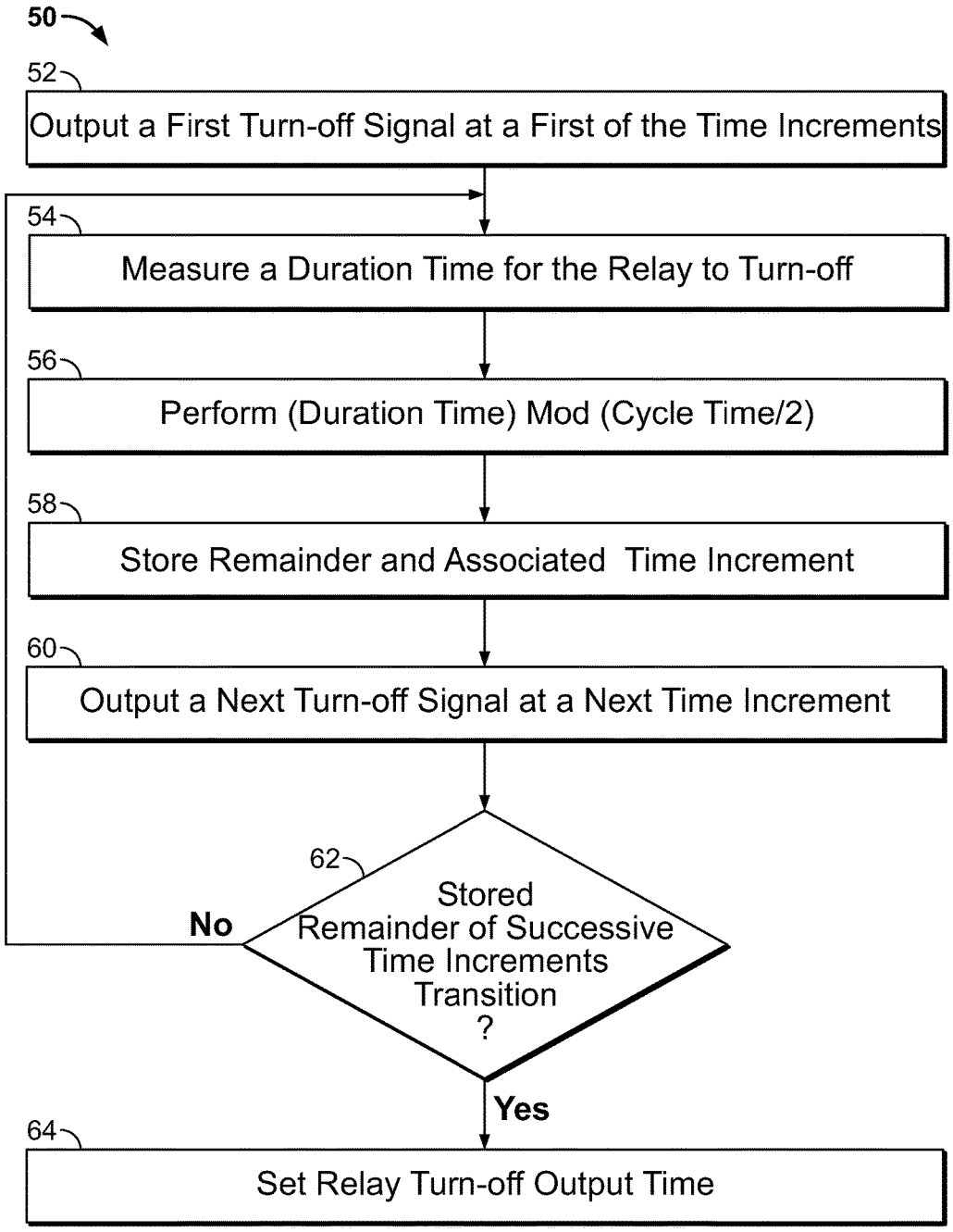
FIG. 5 is an example method that may be performed by a microprocessor.

A method 50, of FIG. 5, may be performed by microprocessor 22 that forms a part of a relay control system 10 for use with an alternating-current (AC) signal input 12. As shown in FIG. 1, the relay control system 10 for method 50 may include a relay 14, a relay current load sensor 16 connected to the relay 14, a rectifier circuit 18 connected to the relay current load sensor 16 and the microprocessor 22 connected to a rectifier circuit output 20.

Referring to FIG. 5, the method 50 may include:

a) outputting a first relay turn-off signal, at 52, to relay 14 at a first of a plurality of successive time increments where each of the plurality of successive time increments combined are equal to a cycle time of the AC signal input;

b) measuring a duration time, at 54, after step a or e, for rectifier circuit output 20 to indicate that relay 14 has turned off;

c) performing a modulo operation, at 56, of (duration time) mod (cycle time/2), wherein a remainder of the modulo operation is one of a non-zero value and a zero value;

d) storing the remainder and an associated time increment, at 58, in memory 44 coupled with the microprocessor 22;

e) outputting a next relay turn-off signal, at 60, to relay 14 at a next of the plurality of successive time increments;

f) repeating steps b-e until the stored remainders of successive modulo operations transition from the non-zero value to the zero value or from the zero value to the non-zero value, as determined at 62; and g) setting a relay turn-off signal output time, at 64, at the associated time increment where the remainder of successive modulo operations transitioned from the non-zero value to the zero value or from the zero value to the non-zero value.

Example embodiments are provided so this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many forms and that neither should be construed to limit the disclosure. In some example embodiments, well-known processes, well-known device structures, and well-known technologies are not described in detail.

The terminology used is to describe particular example embodiments only and is not intended to be limiting. As used, the singular forms "a," "an," and "the" may be intended to include the plural forms, unless the context indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is described as being "on," "engaged to," "connected to," or "coupled to" another element or layer, it may be directly on, engaged, connected or coupled to the other element or layer, or intervening elements or layers may be present. When an element is described as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes all combinations of one or more of the associated listed items.

Although the terms first, second, third, etc. may be used to describe various elements, components, regions, layers and/or sections, these elements, components, regions, layers and/or sections should not be limited by these terms. These terms may only distinguish one element, component, region, layer or section from another region, layer or section. Terms such as "first," "second," and other numerical terms when used imply no sequence or order unless clearly indicated by the context. A first element, component, region, layer or section discussed below could be termed a second element, component, region, layer or section without departing from the teachings of the example embodiments.

The foregoing description of the embodiments has been provided for illustration and description. It is not intended to be exhaustive or to limit the disclosure. Individual elements or features of a particular embodiment are not limited to that embodiment, but, where applicable, are interchangeable and can be used in a selected embodiment, even if not specifically shown or described. The same may also be varied in many ways. Such variations are not to be deemed a departure from the disclosure, and all such modifications are included within the disclosure.

What is claimed is:

1. A relay turn-off control system for use with an alternating-current (AC) signal input, comprising:

a relay;

a relay current load sensor connected to the relay;

a rectifier circuit connected to the relay current load sensor and having an output;

a microprocessor connected to the rectifier circuit output; and wherein the microprocessor is configured to:

a) define a plurality of successive time increments where each of the plurality of successive time increments combined are equal to a cycle time of the AC signal input;

b) output a first relay turn-off signal to the relay at a first of the plurality of successive time increments;

c) measure a duration time, after step b or f, for the rectifier circuit output to indicate that the relay has turned off;

d) perform a modulo operation of (duration time) mod (half the cycle time), wherein a remainder of the modulo operation is one of a non-zero value and a zero value;

e) store the remainder and an associated time increment in a memory coupled with the microprocessor;

f) output a next relay turn-off signal to the relay at a next of the plurality of successive time increments;

g) repeat steps c-f until the stored remainders of successive modulo operations transition from the non-zero value to the zero value or from the zero value to the non-zero value; and h) set a relay turn-off signal output time at the associated time increment where the remainder of successive modulo operations transitioned from the non-zero value to the zero value or from the zero value to the non-zero value.

2. The control system of claim 1, wherein the rectifier circuit output is synchronous with the AC signal input.

3. The control system of claim 1, wherein the cycle time is divided into equal time increments.

4. The control system of claim 3, wherein a number of the plurality of successive time increments is taken from a group consisting of 16, 32, and 64.

5. The control system of claim 1, wherein the duration time is measured from a first rising edge to a last falling edge of the rectifier circuit output.

6. A relay turn-off control system for use with an alternating-current (AC) signal input, comprising:

a relay;

a relay current load sensor connected to the relay;

a rectifier circuit connected to the relay current load sensor and having an output;

a microprocessor connected to the rectifier circuit output; and wherein the microprocessor is configured to set a relay turn-off signal output time based on an empirically determined duration time for the relay to turn-off and further based on determining a zero-cross period via use of a modulo operation;

wherein the zero-cross period is determined by configuring the microprocessor to:

a) define a plurality of successive time increments where each of the plurality of successive time increments combined are equal to a cycle time of the AC signal input;

b) perform a modulo operation of (duration time) mod (half the cycle time), wherein a remainder of the modulo operation is one of a non-zero value and a zero value;

c) store the remainder and an associated time increment in a memory coupled with the microprocessor;

d) output a next relay turn-off signal to the relay at a next of the plurality of successive time increments;

e) repeat steps b-d until the stored remainders of successive modulo operations transition from the non-zero value to the zero value or from the zero value to the non-zero value; and f) set a relay turn-off signal output time at the associated time increment where the remainder of successive modulo operations transitioned from the non-zero value to the zero value or from the zero value to the non-zero value.

7. The control system of claim 6, wherein the empirically determined duration time includes measuring, after the microprocessor outputs a relay turn-off signal to the relay, a time for the rectifier circuit output to indicate that the relay has turned off.

8. The control system of claim 7, wherein the duration time is measured from a first rising edge to a last falling edge of the rectifier circuit output.

9. The control system of claim 6, wherein the cycle time is divided into equal time increments.

10. The control system of claim 6, wherein the rectifier circuit output is synchronous with the AC signal input.

11. A method performed by a microprocessor forming a part of a relay control system for use with an alternating-current (AC) signal input and where the relay control system includes a relay, a relay current load sensor connected to the relay, a rectifier circuit connected to the relay current load sensor and the microprocessor connected to a rectifier circuit output, comprising:

a) outputting a first relay turn-off signal to a relay at a first of a plurality of successive time increments where each of the plurality of successive time increments combined are equal to a cycle time of the AC signal input;

b) measuring a duration time, after step a or e, for the rectifier circuit output to indicate that the relay has turned off;

c) performing a modulo operation of (duration time) mod (half the cycle time), wherein a remainder of the modulo operation is one of a non-zero value and a zero value;

d) storing the remainder and an associated time increment in a memory coupled with the microprocessor;

e) outputting a next relay turn-off signal to the relay at a next of the plurality of successive time increments;

f) repeating steps b-e until the stored remainders of successive modulo operations transition from the non-zero value to the zero value or from the zero value to the non-zero value; and g) setting a relay turn-off signal output time at the associated time increment where the remainder of successive modulo operations transitioned from the non-zero value to the zero value or from the zero value to the non-zero value.

* * * * *